US007089601B2

(12) United States Patent
Chen

(10) Patent No.: US 7,089,601 B2
(45) Date of Patent: Aug. 15, 2006

(54) BUTTOCK FORM ENHANCEMENT DEVICE

(76) Inventor: David Chen, 20912 Granite Wells Rd., Walnut, CA (US) 91789

( * ) Notice: Subject to any disclaimer, the term of this patent is extended or adjusted under 35 U.S.C. 154(b) by 0 days.

(21) Appl. No.: 11/036,099

(22) Filed: Jan. 18, 2005

(65) Prior Publication Data

US 2005/0177926 A1 Aug. 18, 2005

(30) Foreign Application Priority Data

Feb. 18, 2004 (JP) ..... 2004-041728

(51) Int. Cl.
*A41B 9/02* (2006.01)
*A41B 9/00* (2006.01)

(52) U.S. Cl. ..... 2/400; 2/466; 2/455

(58) Field of Classification Search ..... 2/267, 2/268, 400, 403, 406, 228, 238, 227, 466, 2/455, 456; 450/98, 99
See application file for complete search history.

(56) References Cited

U.S. PATENT DOCUMENTS 2,807,805 A * 10/1957 Allan ..... 2/404
3,131,698 A * 5/1964 Morano ..... 450/99
3,295,530 A * 1/1967 Mayer et al. ..... 450/98
4,894,867 A * 1/1990 Ceravolo et al. ..... 2/238
4,969,216 A * 11/1990 Guelli ..... 2/400
5,103,505 A * 4/1992 Llorens ..... 2/400
5,842,232 A * 12/1998 Parrish ..... 2/400
6,182,297 B1 * 2/2001 Duren et al. ..... 2/228

* cited by examiner

*Primary Examiner*—Gloria M. Hale
(74) *Attorney, Agent, or Firm*—Lowe, Hauptman & Berner, LLP

(57) ABSTRACT

The buttock form enhancement device includes a garment, two upper-buttock form pieces and two lower-buttock form pieces, wherein the garment is for covering the lower body portion of the person, and its rear side having two pockets positioned respectively adjacent the buttocks of the wearer. The upper-buttock pieces are placed in the pockets, a volume of fillers are encased between two thin films. The lower-buttock form pieces are beneath and positioned respectively adjacent the upper-buttock form pieces and are placed in the pockets. The shapes and sizes of the pockets are determined by the shapes of the upper-buttock form pieces and the lower-buttock form pieces. The upper-buttock form pieces and the lower-buttock form pieces can get in or out of the pockets.

23 Claims, 6 Drawing Sheets

BUTTOCK FORM ENHANCEMENT DEVICE

BACKGROUND OF THE INVENTION

1. Field of the Invention

The present invention is related to a device to improve the sizes and shapes of a person's buttocks, and especially to a garment with a buttock form enhancement device capable of enhancing the sizes and modeling of a person's buttocks.

2. Description of the Prior Art

Generally, people may not naturally have the desired shape or proportions. However, men or women all pay great attention to their looks; particularly when one is getting old or ill, he is subjected to form a more ugly appearance, and particularly hopes to the appearance what he desires by every way. Faces, breasts, buttocks, thighs or any of the other bodily portions can be the portions that people eagerly improve to obtain a desired figure. Among these, enlarging or changing the shapes of buttocks only by exercising or diet is not easy. A more effective way that can get a little effect is a surgical operations, changing appearances of buttocks by shaping girdles or pants or inserting foam material into garment. The above way has its defects such as the risk of probable failure, a long-term influence and the expensive charges of a surgical operation, and the discomfort and inferior effect causing by shaping girdles or pants.

As shown in FIG. 1, a conventional buttock-shaped padding device 10 is depicted, the padding device 10 comprises a piece of garment 12 made of conventional material for a shirt and used for covering the lower body portion of a person, it has openings 14, 16 for accommodation of his waist and thighs, and has a shape like a pair of paints, a skirt etc. FIG. 1 shows the rear side of the garment 12; and comprises two pockets 18 sewn on the garment 12 and positioned adjacent the buttocks, each pocket 18 receives therein a buttock-shaped piece 20 made of foam material, the shapes and the sizes of the pockets 18 are formed by means of the buttock-shaped pieces 20, each pocket 18 has a flap (not shown), the buttock-shaped pieces 20 can be taken out for cleansing the garment 12 and put back after cleansing.

FIGS. 2A and 2B show a buttock-shaped piece 20 of a conventional buttock-shaped padding device, especially we can see from FIG. 2A that the buttock-shaped piece 20 is a single piece structure with an oval shape for covering a person's buttocks, it is made of foam material with low or high density and being light by weight. FIG. 2B is a longitudinal sectional view of the thickness of the buttock-shaped piece 20 being symmetric moving from a midpoint 23 of the buttock-shaped piece 20 to a top 25 and to a bottom 27. Therefore, when a person wears on such buttock-shaped pieces 20, a feeling of being unnatural of the buttock shape and having a foreign matter on the buttock is induced. Especially when the buttock-shaped pieces 20 are used on a piece of close-fitting garment, the contour of the buttock-shaped pieces 20 will appear on the garment to destroy the visual esthetic feeling, and the buttock-shaped pieces 20 are subjected to displacing to induce discomfort especially when the symmetrical thickness in the longitudinal sectional diagram of each of the buttock-shaped pieces 20 is not good for a wearer having buttocks each being not symmetrical by shape (such as the sagging buttocks), such a device is unable to make the shapes of the buttocks better. And more, the wearer will feel foreign on the buttocks. People touching the conventional buttock-shaped padding device can feel the existence of the hard part.

In view of these, the inventor of the present invention provides a buttock form enhancement device to get rid of the above defects.

SUMMARY OF THE INVENTION

The primary object of the present invention is to provide a buttock form enhancement device to improve the curvatures of people's buttocks to increase beauty of their appearances.

Another object of the present invention is to provide a buttock form enhancement device that is easy for wearing on without a feeling of discomfort.

The secondary object of the present invention is to provide a buttock form enhancement device that makes a wearer have no feeling of having foreign matters on user's buttocks, nor another person touching him feel the existence of a pad.

In order to get the above objects, the buttock form enhancement device of the present invention comprises a piece of garment, two upper-buttock form pieces and two lower-buttock form pieces; wherein the garment is for covering the lower body portion of the person (especially the buttocks), and has a rear side having two pockets being positioned respectively adjacent the buttocks of the wearer; the upper-buttock form pieces are placed in the pockets, a volume of fillers are encased between two thin films of them; the lower-buttock form pieces are juxtaposed respectively with the upper-buttock form pieces and are placed in the pockets.

The present invention will be apparent after reading the detailed description of the preferred embodiment thereof in reference to the accompanying drawings.

DETAILED DESCRIPTION OF THE PREFERRED EMBODIMENT

Figure 1:
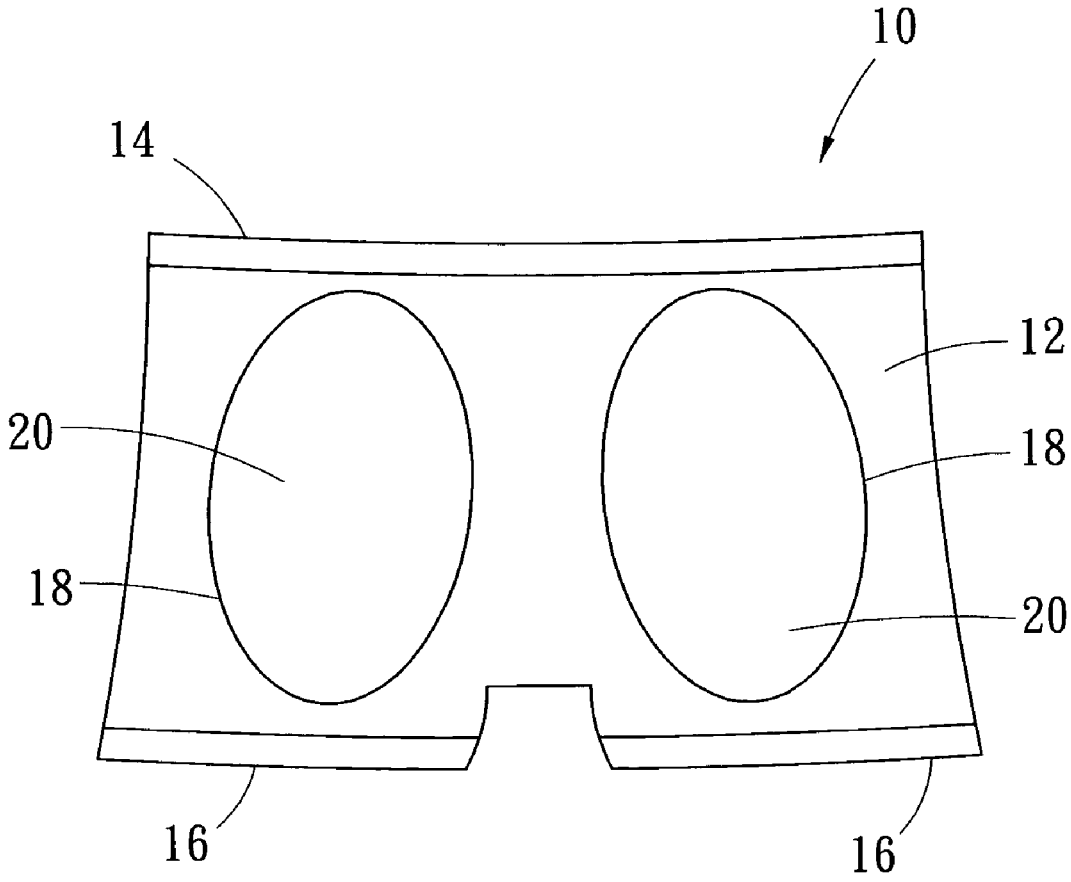
Fig. 1 (Prior Art)
FIG. 1 is a schematic view showing a conventional buttock-shaped padding device.
Figure 2A:
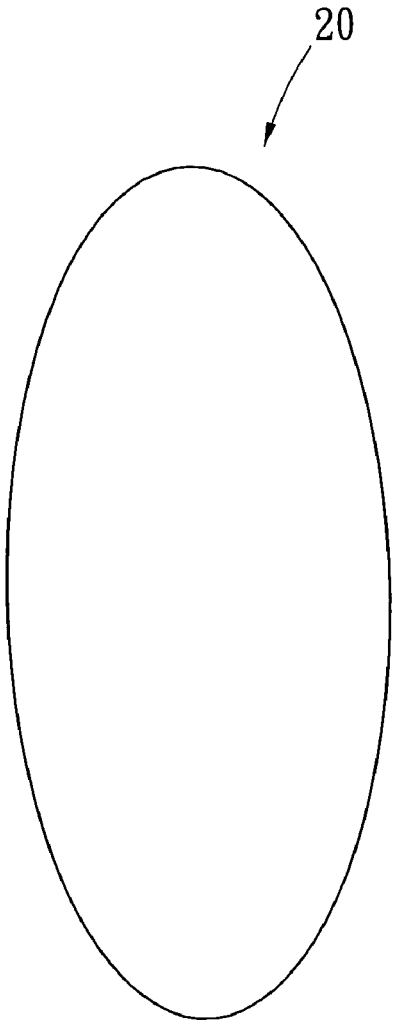
Fig. 2A (Prior Art)
FIGS. 2A and 2B are schematic views showing a conventional buttock-shaped piece.
Figure 2B:
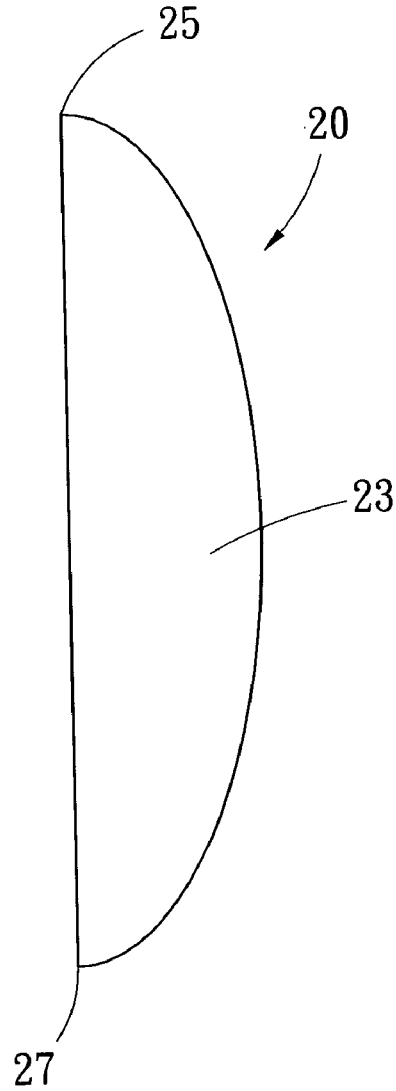
Fig. 2B (Prior Art)
Figure 3A:
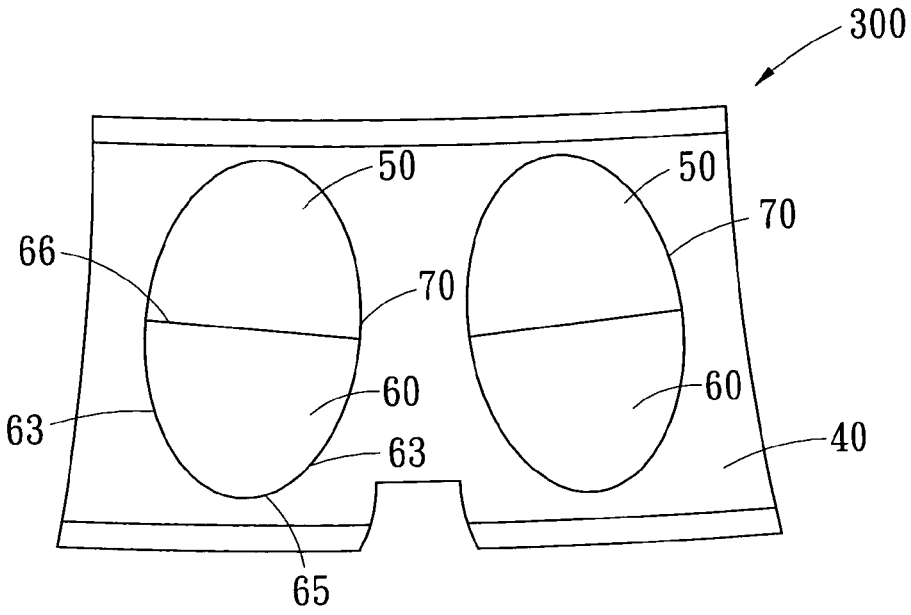
FIG. 3A is a schematic view showing a buttock form enhancement device of the present invention.
Figure 3B:
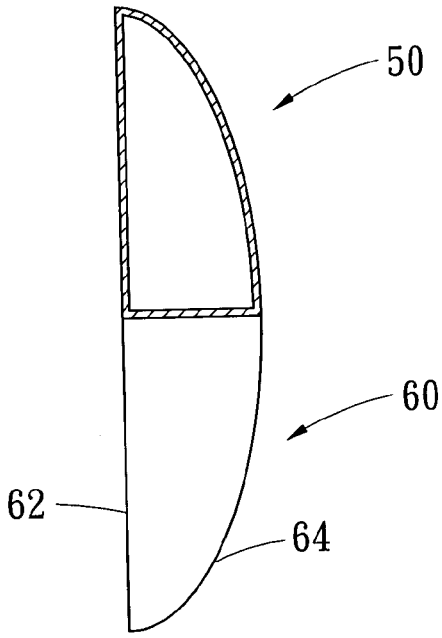
FIG. 3B is a sectional schematic view showing an upper-buttock form piece and a lower-buttock form piece of the present invention.

Referring firstly to FIGS. 3*a* and 3*b*, wherein a buttock form enhancement device 300 of the present invention comprises a piece of garment 40, two upper-buttock form pieces 50 and two lower-buttock form piece 60, wherein the garment 40 such as a pair of pants or a skirt has a rear side having two pockets 70 being positioned respectively adjacent the buttock of a wearer for covering the lower body portion of the person, especially the buttocks. The shape of each of the pockets 70 has an envelope structure for receiving an upper-buttock form piece 50 and a lower-buttock form piece 60, and has a shape that is determined by the shapes of the upper-buttock form piece 50 and the lower-buttock form piece 60; each pocket 70 has an opening (not shown), so that the upper-buttock form piece 50 and the lower-buttock form piece 60 can get in or out of the opening. The upper-buttock form piece 50 has a volume being ¼ to ½ proportionally of the gross volume of the upper-buttock form piece 50 and the lower-buttock form piece 60. The lower-buttock form piece 60 has a volume being ¼ to ¾ proportionally of the gross volume of the upper-buttock form piece 50 and the lower-buttock form piece 60.

Figure 4A:
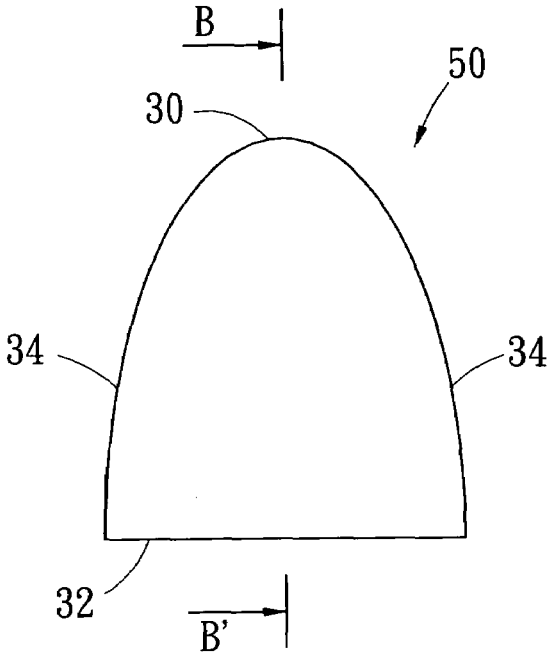
FIG. 4A is a schematic view showing a preferred embodiment of upper-buttock form piece of the present invention.
Figure 4B:
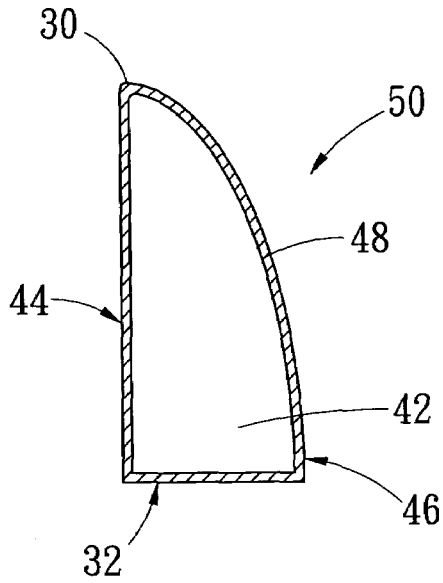
FIG. 4B is a sectional schematic view taken along the line B–B' of FIG. 4A to further show the preferred embodiment of the upper-buttock piece of the present invention.

Referring to FIG. 4A, the upper-buttock form piece 50 has a top portion 30, a bottom portion 32 and a lateral portion 34 extending from the top portion 30 to the bottom portion 32 to form a semi-oval shape. This does not, however, limit the shape or size of the upper-buttock form piece 50, rather, this is only to present a preferred embodiment. Referring to FIG. 4B, a sheet member 48 of the upper-buttock form piece 50 is formed thereon an internal surface 44, an external surface 46 and a bottom portion 32, a predetermined volume of fillers 42 are sealed in the sheet member 48. The fillers 42 can be gel, and are most preferably silicone gel. The sheet member 48 can be made of foam material, plastic, rubber, fabric, non-woven fabric; polyurethane or a kind of mixed material formed from the above materials. In the most preferred embodiment, the sheet member 48 is made of thermoplastic material in the film type. The method of encasing the gel is that: several sheet member made of the thermoplastic material are heated and sealed along the peripheral edge to form the upper-buttock form piece 50. Alternatively, it can be made by folding and sealing a single sheet member. The internal surface 44 and the external surface 46 of the upper-buttock form piece 50 can be added with a covering layer (not shown) such as a fabric layer, a non-woven fabric layer or a layer of some other suitable material, especially the material of fabric can be a two-way or four-way stretchable material suitable for wearing on buttocks, the covering scope of the covering layer can include all or part of the internal surface 44 and the external surface 46 by a connecting mode of fixed or removable connecting. The internal surface 44 is a plane surface; the external surface 46 is an arciform surface with a suitable curvature. The two surfaces 44, 46 meet at the top portion 30. It can be seen from FIG. 4B that thickness of the upper-buttock form piece 50 is gradually enlarged from the top portion 30, and is largest at the bottom portion 32. Therefore, the upper-buttock form piece 50 can modify the shape of a buttock of the wearer to endue it with a graceful shape. And by combination of the sheet member 48 and the fillers 42, not only the appearance of the buttock of the wearer can be improved, but also the wearer will not feel foreign on the buttock. Feeling of touching the upper-buttock form piece 50 can be natural and cozy.

Figure 4C:
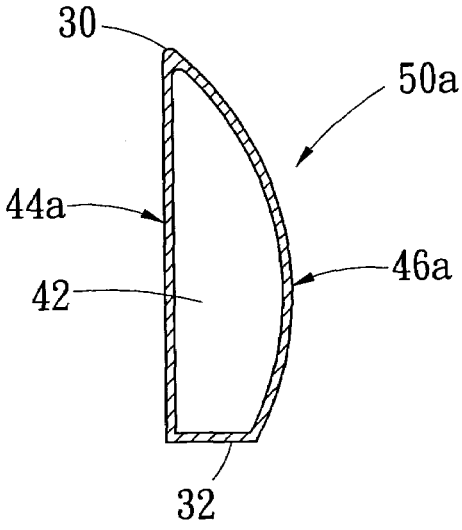
FIG. 4C is a sectional schematic view showing another preferred embodiment of upper-buttock form piece of the present invention.

Referring to FIG. 4C, the shape of an upper-buttock form piece 50*a* can be suitable for a user having specific-shaped buttocks, such as sagging buttocks, the scope of the upper-buttock form piece 50*a* is defined by a plane internal surface 44*a*, an arciform external surface 46*a* and a bottom portion 32, the radian of the external surface 46*a* can be a part of a circle with a suitable radius of curvature. As to the top portion 30 and to the bottom portion 32 of the upper-buttock form piece 50*a*, the thickness of the upper-buttock form piece 50*a* in the sectional view is not symmetrical. The thickness gradually increases from the top portion 30 downwards, it is the largest at the middle from the top portion 30 to the bottom portion 32, the thickness reduces gradually thereafter toward the bottom portion 32. In this mode, the upper half part and the lower half part of the upper-buttock form piece 50*a* get richer character which can complement the sagging shapes of the upper buttocks.

Figure 4D:
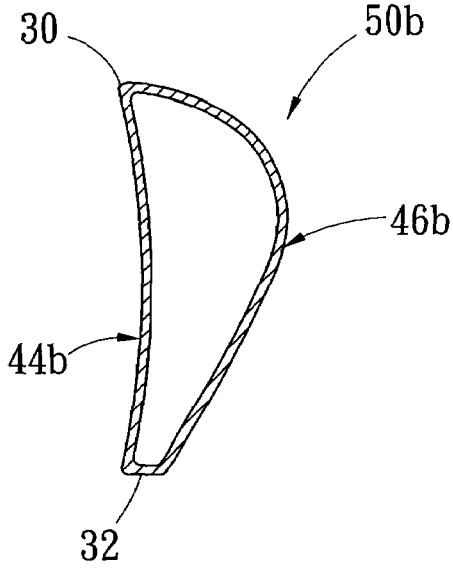
FIG. 4D is a sectional schematic view showing the another preferred embodiment of upper-buttock form piece of the present invention.

Referring to FIG. 4D, the shape of an upper-buttock form piece 50*b* is another preferred embodiment of the upper-buttock form piece for modifying the sagging buttock shapes of a user. The upper-buttock form piece 50*b* includes an internal surface 44*b* and an external surface 46*b* respectively having a radian being arciform or being a part of a circle with a suitable radius of curvature; especially when the radius of the external surface 46*b* of the circle with the radius of curvature stated is smaller than that of the internal surface 44*b*, a more mellow and fuller appearance can be obtained. By using techniques of designing, the upper half part of the upper-buttock form piece 50*b* can have a thicker profile than that of the lower half part of the upper-buttock form piece 50*b*, so that a wearer having sagging buttocks can have a more graceful buttock shape when wearing on the upper-buttock form piece 50*b*.

As shown in FIGS. 3A and 3B, the lower-buttock form piece 60 is positioned adjacent the upper-buttock form piece 50 and is placed in the pocket 70. The lower-buttock form piece 60 has a top portion 66, a bottom portion 65, and lateral portion 63 extending therebetween. It has a shape as an extension of the upper-buttock form piece 50. The lower-buttock form piece 60 fitted with the upper-buttock form piece 50 could form a pad with buttock shape. Particularly, the junction of the bottom portion 32 of the upper-buttock form piece 50 configured for placement adjacent the top portion 66 of the lower-buttock form piece 60 provides a smooth and unnoticeable transition. The lower-buttock form piece 60 has an internal surface 62 and an external surface 64 with structures and of materials same as those of the upper-buttock form piece 50. However, the preferred embodiment of it is made of non-gelatinous or non-liquid material such as foam material or rubber, thereby the weight of the buttock form enhancement device of the present invention can be reduced, while the contour of the buttocks can maintained.

Figure 5:
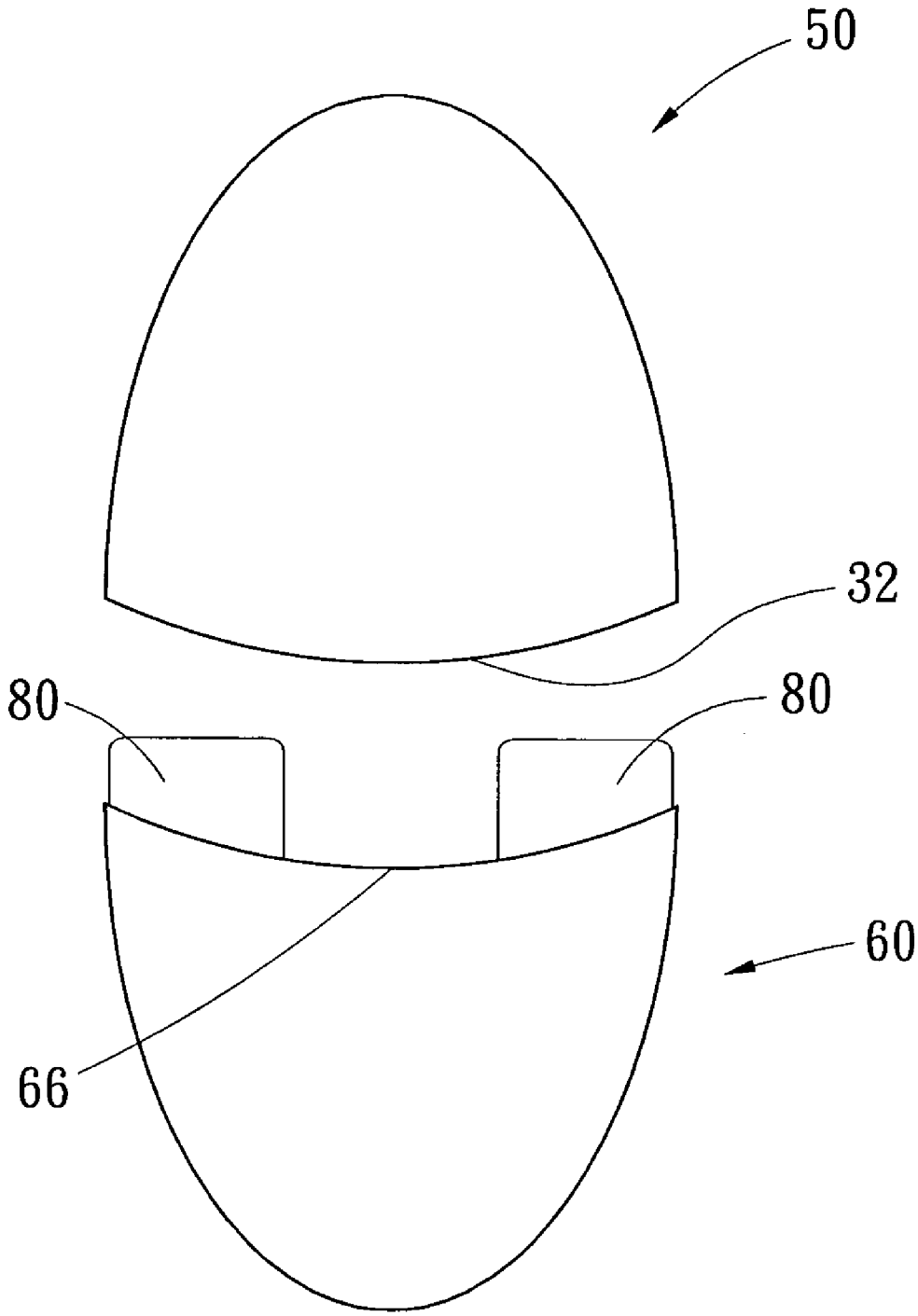
FIG. 5 is a sectional schematic view showing an upper-buttock form piece and a lower-buttock form piece separable from each other of the present invention.

The upper-buttock form piece 50 and the lower-buttock form piece 60 can be integrally connected with each other, as shown in FIG. 5. They can also be connected by means of a connecting device 80 which is depicted in the drawing as a set of connecting pieces, the upper-buttock form piece 50 and the lower-buttock form piece 60 thereby can be connected and separated. The bottom portion 32 of the upper-buttock form piece 50 is positioned adjacent the top portion 66 of the lower-buttock form piece 60. The connecting device 80 can be of any suitable shapes, sizes or forms such as VELCRO™, connecting buttons, engaging hooks etc. Or the connecting device is directly placed between the bottom portion 32 of the upper-buttock form piece 50 and the top portion 66 of the lower-buttock form piece 60 for connecting each other. The above embodiments are only for disclosing some probable forms and are not for giving any limitation to the scope of the present invention. It will be apparent to those skilled in this art that various equivalent modifications or changes without departing from the spirit of this invention shall also fall within the scope of the appended claims.

Figure 6:
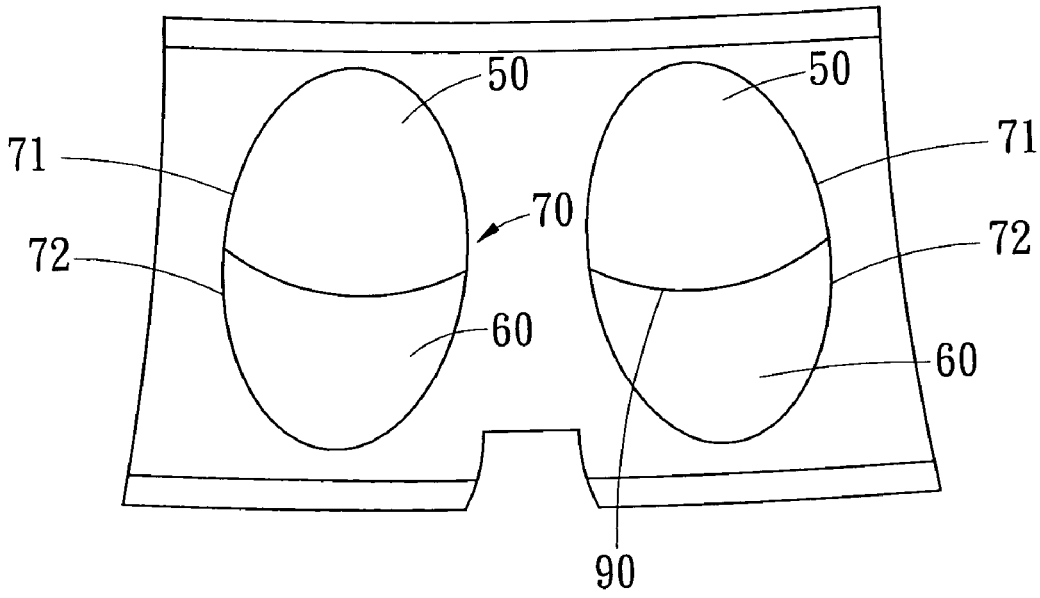
FIG. 6 is a schematic view showing another preferred embodiment of buttock form enhancement device of the present invention.

Referring to FIG. 6, when the upper-buttock form piece 50 and the lower-buttock form piece 60 are separated from each other to be independent individuals, each bag 70 can be designed to have and upper pocket part 71 and a lower pocket part 72. They are separated with a separating means or sewing seam 90. The upper and the lower pocket parts 71, 72 respectively have their openings; so that the upper-buttock and the lower-buttock form piece 50, 60 can be respectively placed in or removed from the upper and the lower bag parts 71, 72, and can be placed only in the upper-buttock form piece 50 or the lower-buttock form piece 6 according to the fondness or requirement of a user. With the above stated buttock form enhancement device of the present invention including bags and upper-buttock and lower-buttock form pieces, the shapes and sizes of the buttock pieces can be selected according to the fondness or requirement of a user. The most preferred situation is that, the user can order a plurality of pockets and upper-buttock and lower-buttock form pieces with corresponding shapes and sizes according to the shapes of the user's buttocks, so that the best appearance when wearing on the buttock form enhancement device can be obtained.

Consequently, the present invention has the following advantages:

1. The buttock form enhancement device of the present invention renders a wearer to get natural modifying, and to have no feeling of having foreign matters on his buttocks by suitable material and structural designing.
2. Designing of the lower-buttock form pieces of the buttock form enhancement device of the present invention allows the wearer to select among various sizes and shapes flexibly, and either only the upper (or the lower) ones or both of the upper and the lower ones of the buttock pieces can be used to change or improve the shapes of the buttocks to get an desired appearance.

In conclusion, according to the description disclosed above, the present invention surely can get the expected object thereof to provide a buttock form enhancement device having simple structure, various and practicable modeling, and is high industrial valuable, what I claim as new and desire to be secured by Letters Patent of the United States are:

1. A buttock form enhancement device comprising:

a garment for covering a lower body portion of a person and having a rear side having two pockets being positioned respectively adjacent buttocks of said person;

two upper-buttock form pieces respectively placed in said pockets with one of said upper-buttock formed pieces in each of said pockets, a volume of fillers being encased between two thin films of each of said upper-buttock form pieces;

two lower-buttock form pieces being positioned respectively with one of said lower-buttock form pieces placed in each of said pockets adjacent one of said upper-buttock form pieces, and each of said upper-buttock form pieces fitted with one of said lower-buttock form pieces forming a buttock form pad for enhancing the curvature of the wearer's buttocks.

2. The buttock form enhancement device as in claim 1, wherein: each of said upper-buttock form pieces are separably connected with a corresponding one of said lower-buttock form pieces by a connecting device.

3. The buttock form enhancement device as in claim 2, wherein: said connecting device is a set of connecting pieces.

4. The buttock form enhancement device as in claim 1, wherein: said upper-buttock form pieces are respectively fixedly connected with said lower-buttock pieces.

5. The buttock form enhancement device as in claim 1, wherein: each of said pockets has an opening in order that each of said upper-buttock form pieces and a corresponding one of said lower-buttock form pieces get in or out of said opening.

6. The buttock form enhancement device as in claim 1, wherein: said thin films are of thermoplastic material.

7. The buttock form enhancement device as in claim 1, wherein: said fillers are of silicone gel.

8. The buttock form enhancement device as in claim 1, wherein: said lower buttock form pieces include foam material.

9. The buttock form enhancement device as in claim 1, wherein: longitudinal sectional thickness of each of said upper-buttock form pieces is gradually enlarged from a top portion thereof downwards, and it is largest at the middle from said top portion to a bottom portion, said thickness reduces gradually thereafter from said middle toward said bottom portion of said upper-buttock form piece.

10. The buttock form enhancement device as in claim 1, wherein: longitudinal sectional thickness of each of said upper-buttock form pieces is gradually enlarged from a top portion thereof, and is largest at a bottom portion thereof.

11. The buttock form enhancement device as in claim 1, wherein: each of said upper-buttock form pieces has a volume being ¼ to ½ proportionally of a gross volume of a corresponding one of said upper-buttock form pieces and said lower-buttock form piece.

12. The buttock form enhancement device as in claim 1, wherein: each of said lower-buttock form pieces has a volume being ¼ to ¾ proportionally of a gross volume of a corresponding one of said upper-buttock form pieces and said lower-buttock form piece.

13. A buttock form enhancement device comprising:

a garment for covering a lower body portion of a person and having a rear side having two upper pockets and two lower pockets being positioned respectively adjacent buttocks of said person;

two upper-buttock form pieces respectively placed in said upper pockets with one of said upper-buttock form pieces in each of said upper-pockets, a volume of fillers being encased between two thin films of each of said upper-buttock form pieces;

two lower-buttock form pieces being positioned respectively adjacent said upper-buttock form pieces and placed in said lower pockets with one of said lower-buttock form pieces in each of said lower pockets, and each of said upper-buttock piece fitted with said lower-buttock piece forming a buttock form pad for enhancing the curvature of the wearer's buttocks.

14. The buttock form enhancement device as in claim 13, wherein: each of said upper-buttock form pieces are separably connected with a corresponding one of said lower-buttock form pieces by a connecting device.

15. The buttock form enhancement device as in claim 14, wherein: said connecting device is a set of connecting pieces.

16. The buttock form enhancement device as in claim 13, wherein: each of said pockets has an opening in order that each of said upper-buttock form pieces and a corresponding one of said lower-buttock form pieces get in or out of said opening.

17. The buttock form enhancement device as in claim 13, wherein: said thin films are of thermoplastic material.

18. The buttock form enhancement device as in claim 13, wherein: said fillers are of silicone gel.

19. The buttock form enhancement device as in claim 13, wherein: said lower-buttock form pieces include foam material.

20. The buttock form enhancement device as in claim 13, wherein: longitudinal sectional thickness of each of said upper-buttock form pieces is gradually enlarged from a top portion thereof downwards, and it is largest at the middle from said top portion to a bottom portion, said thickness reduces gradually thereafter from said middle toward said bottom portion of said upper-buttock form piece.

21. The buttock form enhancement device as in claim 13, wherein: longitudinal sectional thickness of each of said upper-buttock form pieces is gradually enlarged from a top portion thereof, and is largest at a bottom portion thereof.

22. The buttock form enhancement device as in claim 13, wherein: each of said upper-buttock form pieces has a volume being ¼ to ½ proportionally of a gross volume of a corresponding one of said upper-buttock form pieces and said lower-buttock form piece.

23. The buttock form enhancement device as in claim 13, wherein: each of said lower-buttock form pieces has a volume being ¼ to ¾ proportionally of a gross volume of a corresponding one of said upper-buttock form pieces and said lower-buttock form piece.

* * * * *